US006359965B1

(12) United States Patent
Finkler et al.

(10) Patent No.: US 6,359,965 B1
(45) Date of Patent: Mar. 19, 2002

(54) DIAGNOSTIC RADIOGRAPHY SYSTEM WITH A FLAT X-RAY IMAGE CONVERTER WITH BACK-ILLUMINATION

(75) Inventors: Klaus Finkler, Spardorf; Kurt Grapengeter, Moehrendorf; Thomas Schirl, Forchheim; Reiner E. Schulz, Dormitz; Reiner Staab, Baiersdorf, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/625,525

(22) Filed: Jul. 26, 2000

(30) Foreign Application Priority Data

Jul. 26, 1999 (DE) ..... 199 34 980

(51) Int. Cl.[7] ..... H05G 1/64
(52) U.S. Cl. ..... 378/98.3; 378/98.8; 250/370.09
(58) Field of Search ..... 378/98.3, 98.8; 250/370.09

(56) References Cited

U.S. PATENT DOCUMENTS 4,982,418 A 1/1991 Kuehnel ..... 378/95
5,448,613 A 9/1995 Haendle et al. ..... 378/98.7
5,757,884 A 5/1998 Alexandrescu ..... 378/98.7
5,864,146 A * 1/1999 Karellas ..... 250/581

FOREIGN PATENT DOCUMENTS

DE PS 44 20 603 6/1995
DE OS 197 43 523 4/1999

* cited by examiner

*Primary Examiner*—Robert H. Kim
*Assistant Examiner*—Jurie Yun
(74) *Attorney, Agent, or Firm*—Schiff Hardin & Waite

(57) ABSTRACT

A diagnostic radiography system has an X-ray generator for emitting an X-ray beam, a planar X-tray image converter with a sensor unit with photosensitive pixel elements that are arranged in a matrix and, arranged behind the sensor unit in the direction of radiation, a back-illumination which is formed by elements that are arranged in a matrix are connected to a control device. When the back-illumination is switched on, the output signal of the sensor unit is measured, and the elements of the back-illumination are triggered individually by the control device for homogenization in the sense of producing a uniform output signal.

5 Claims, 1 Drawing Sheet

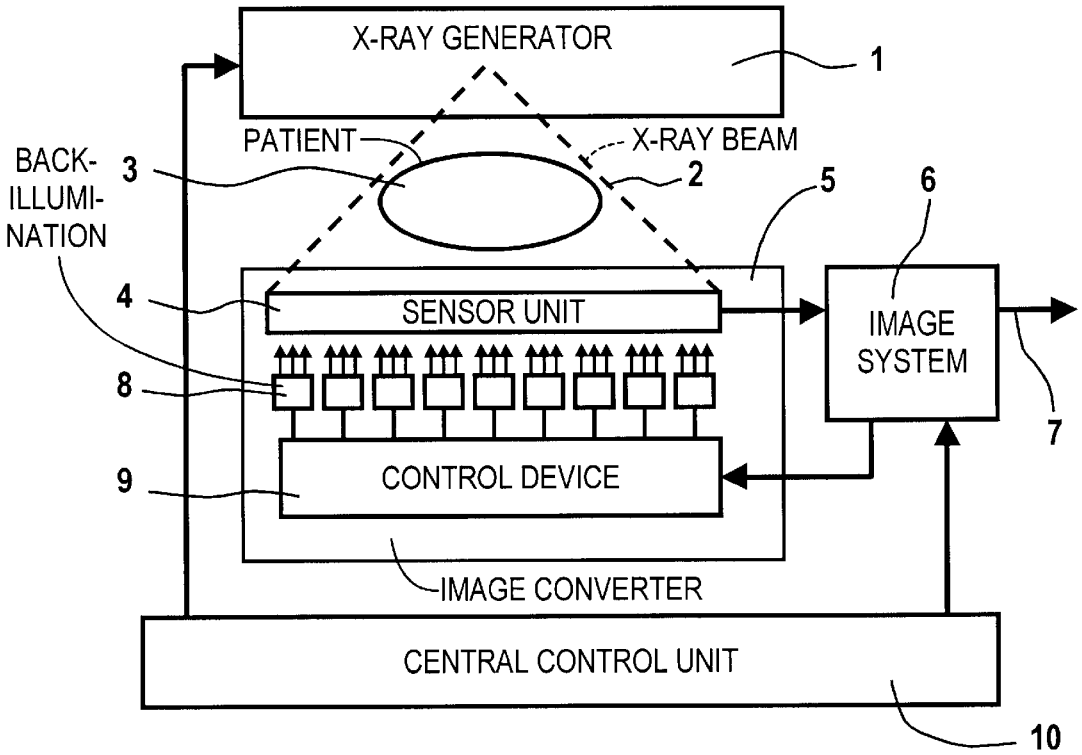
X-RAY GENERATOR
1
PATIENT
X-RAY BEAM
BACK-
ILLUMI-
NATION
3
2
5
6
4
SENSOR UNIT
IMAGE
SYSTEM
8
7
9
CONTROL DEVICE
IMAGE CONVERTER
CENTRAL CONTROL UNIT
10

DIAGNOSTIC RADIOGRAPHY SYSTEM WITH A FLAT X-RAY IMAGE CONVERTER WITH BACK-ILLUMINATION

BACKGROUND OF THE INVENTION

1. Field of the Invention

The present invention relates to a diagnostic radiography system of the type having an X-ray generating unit for emitting an X-ray beam, a flat X-ray image converter that has a sensor unit with photosensitive pixel elements that are arranged in a matrix and an array which is arranged behind the sensor unit in the direction of radiation and LEDs that are arranged in a matrix as back-illumination, at least part of which capture the X-ray dose as a detector.

2. Description of the Prior Art

U.S. Pat. No. 5,757,884 describes this type of diagnostic radiography system with a flat X-ray converter having a scintillator layer and a semiconductor layer with photosensitive pixel elements that are arranged in a matrix as a sensor unit, and with an array, which is arranged behind this sensor unit in the direction of radiation, and LEDs that are arranged in a matrix as back-illumination, at least a part of which capture the X-ray dose as a detector.

In such solid state X-ray detectors which utilize amorphous semiconductors such as a-Si or a-Se, the back-illumination of the semiconductor structure is provided in order to improve the time behavior of the signal. The back-illumination typically consists of several sub-surfaces or modules which combine to form a compute surface large enough to illuminate all semiconductor pixel elements, for instance photodiodes. This illumination must be very homogeneous, since a non-homogeneous, chronologically unstable back-illumination leads to disturbing image artefacts.

SUMMARY OF THE INVENTION

An object of the present invention is to provide a back-illumination for a sensor unit of the type described above so as to produce a homogenous illumination which is chronologically stable.

The object is inventively achieved in an image converter wherein the elements of the back-illumination are connected to a control device, and when the back-illumination is activated the output signal of the sensor unit is measured, and the elements of the back-illumination are individually controlled by the control device for homogenization in the sense of a uniform output signal. With such measuring of the homogeneity of the back-illumination which is conducted frequently in the background, and with corresponding adjusting of the individual trigger powers of the elements, the illumination homogeneity can be improved. Here, the capability of the sensor unit to be sensitive not only to X-radiation from the front but also to visible light from the back is exploited.

It has proven advantageous for the elements of the back-illumination to be formed as modules with LEDs that are arranged in the form of a matrix.

The computing power in an image system that is already present in the system can be used when it is connected to the sensor unit for measuring its output signal.

A simple control is obtained when in an embodiment wherein a central unit detects when the X-ray generator is not active and emits a start signal to the image system and/or the control device in order to initiate and control the homogenization.

The image converter can advantageously employ and aSi:H detector.

DESCRIPTION OF THE DRAWINGS

The single FIGURE is a schematic illustration of a diagnostic radiography system having a flat X-ray image converter with back illumination, constructed and operating in accordance with the principles of the present invention.

DESCRIPTION OF THE PREFERRED EMBODIMENTS

The FIGURE shows a diagnostic radiography system with an X-ray generator 1 including an X-ray tube which is operated by a high voltage generator. The X-ray generator 1 emits an X-ray beam 2, which penetrates a patient 3 and attenuated dependent on the transparence of the patient 3, is incident at a sensor unit 4 of an X-ray image converter 5 as an X-ray image. The sensor unit 4 is connected to an image system 6, which can include a processing circuit with computing circuits, filtering circuits, image storage units and converts in known fashion, which are not represented in the figure. The image data 7 are fed to a monitor, which is likewise not represented, for reproducing the X-ray image.

The sensor unit 4 is formed as a scintillator layer on which the X-ray beam 2 is incident which is thereby converted into a visible X-ray image corresponding to the attenuation by the patient 3. The scintillator layer can consist of cesium iodide (CsI). A semiconductor layer, which consists of amorphous silicon doped with hydrogen (aSi:H), for example, is coupled to the scintillator layer. The scintillator layer has a number of photosensitive pixel elements that are arranged in a matrix.

As seen in the direction of incoming radiation, a back-illumination 8 is arranged behind the semiconductor layer. The back-illumination 8 can be formed as an array of 9*9 modules of LEDs that are arranged in a matrix for resetting residual charges of the pixel elements by illuminating the semiconductor layer of the sensor unit 4. The back-illumination 8 is connected to a control device 9 by which the LEDs of the module are switched on, so that the semiconductor layer can be exposed in the pauses between the X-ray irradiation, and the residual charges of the pixel elements can thus be reset.

A central control unit 10, for instance a host computer, takes over the control of all time sequences, this being connected specifically to the X-ray generator 1 and the image system 6, and generates the system and control clocks.

In normal operation, the sensor unit 4 in the X-ray image converter 5 receives the radiation field behind the patient 2. The image system 6 performs the necessary computing operations and delivers the finished image data 7. The control unit 6 controls and synchronizes the sequences.

The inventive diagnostic radiography system allow the measurement of the current local light distribution and the subsequent homogenization. To this end, an image is picked up with x-rays not being applied, but with the light from the back-illumination 8 exposing the semiconductor layer of the sensor unit 4. This image contains information about the light yield and efficiency of the individual modules of the back-illumination 8. From this image, the computing unit in the image system 6 can compute how the trigger powers of the individual modules 8 must be modified to achieve a homogenous back-illumination. The control device 9 modifies the individual trigger powers accordingly.

This inventive homogenization of the back-illumination 8 is very stable over time and can operate in the background unnoticed by the apparatus operator, since no X-radiation is used.

Although modifications and changes may be suggested by those skilled in the art, it is the intention of the inventors to embody within the patent warranted hereon all changes and modifications as reasonably and properly come within the scope of their contribution to the art.

We claim as our invention:

1. A diagnostic radiography system comprising:

an X-ray emitter which emits an X-ray beam;

a planar X-ray converter on which said X-ray beam is incident, said planar X-ray converter comprising a sensor unit having photosensitive elements arranged in a matrix, and a back-illuminating arranged behind said sensor unit in a direction of propagation of said X-ray beam, said back-illumination consisting of illumination elements arranged in a matrix; and a control device connected to said illumination elements of said back-illumination for individually triggering said illumination elements to obtain a homogenized, uniform output signal from said sensor unit.

2. A diagnostic radiography system as claimed in claim 1 wherein said illumination elements consist of a plurality of modules, each module containing light-emitting diodes arranged in a matrix.

3. A diagnostic radiography system as claimed in claim 1 further comprising an imaging system connected to said sensor unit for measuring said output signal.

4. A diagnostic radiography system as claimed in claim 1 further comprising a central control unit connected to said X-ray emitter and sensing when said X-ray emitter is not emitting said X-ray beam, said central control unit thereupon supplying a start signal to said control device for said back-illumination to initiate triggering of said illumination elements.

5. A diagnostic radiography system as claimed in claim 1 wherein said image converter comprises an aSi:H detector.

* * * * *